US008419502B2

(12) United States Patent
Liu

(10) Patent No.: US 8,419,502 B2
(45) Date of Patent: Apr. 16, 2013

(54) BREAST PAD CONSTRUCTION WITH IMPROVED NIPPLE CONCEALMENT

(75) Inventor: Zhen Qiang Liu, Kuai Chung (HK)

(73) Assignees: Victoria's Secret Stores Brand Management, Reynoldsburg, OH (US); Purdue Research Foundation, West Lafayette, IN (US)

( * ) Notice: Subject to any disclaimer, the term of this patent is extended or adjusted under 35 U.S.C. 154(b) by 257 days.

(21) Appl. No.: 12/964,829

(22) Filed: Dec. 10, 2010

(65) Prior Publication Data

US 2012/0149278 A1 Jun. 14, 2012

(51) Int. Cl.
*A41C 3/00* (2006.01)

(52) U.S. Cl.
USPC ..... 450/39; 450/57; 450/54

(58) Field of Classification Search ..... 450/39, 450/54, 58; 2/267, 268; 623/7, 8
See application file for complete search history.

(56) References Cited

U.S. PATENT DOCUMENTS 4,557,267 A * 12/1985 Cole ..... 450/40
7,081,034 B1 * 7/2006 Zoellner ..... 450/54
7,311,585 B2 12/2007 Togawa et al.
2006/0030238 A1 * 2/2006 Jagaric et al. ..... 450/57
2009/0130953 A1 * 5/2009 Gransberry ..... 450/39

OTHER PUBLICATIONS

International Search Report and Written Opinion for PCT/US2011/062222 dated Mar. 8, 2012.

* cited by examiner

*Primary Examiner* — Gloria Hale
(74) *Attorney, Agent, or Firm* — Andrus, Sceales, Starke & Sawall, LLP

(57) ABSTRACT

A bra or other garment pad for breast support has a top fabric layer, a top polyurethane foam layer adhered to the top fabric layer and a nipple concealing disk of shaved polyurethane foam adhered to or formed as part of the top foam layer. The disk is at a nipple covering location of an outer perimeter of the pad and is substantially circular, and is spaced inwardly on all sides from the outer perimeter of the pad. The disk has a graduated thickness at a minimum at the disk perimeter and increasing to a maximum at its center. A substantially 100% spandex fabric layer is adhered to the inner surface of the top foam layer and disk and a bottom polyurethane foam layer is adhered to an inner surface of the spandex layer with a fabric lining layer adhered to the bottom foam layer.

20 Claims, 4 Drawing Sheets

FIG. 6
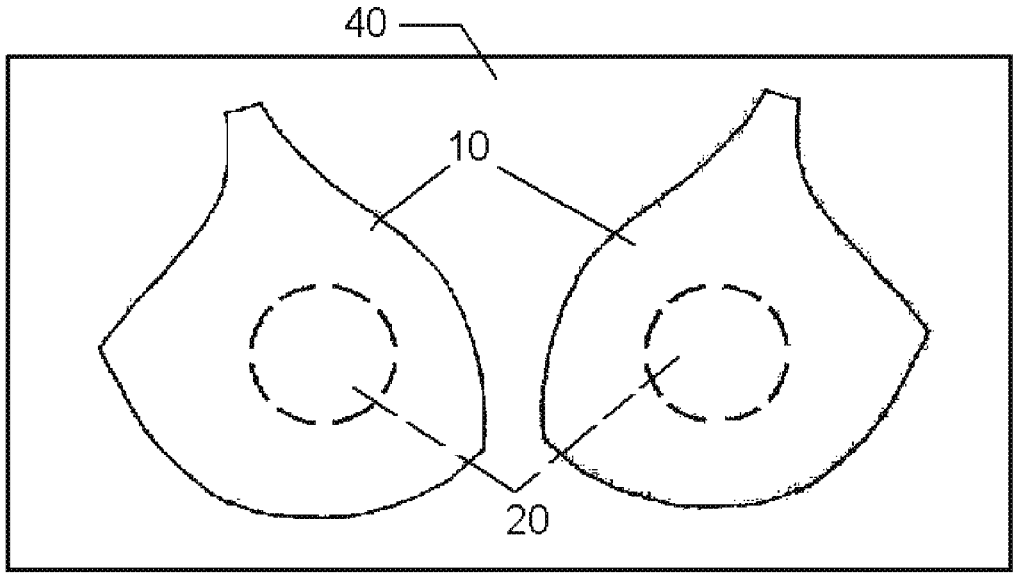
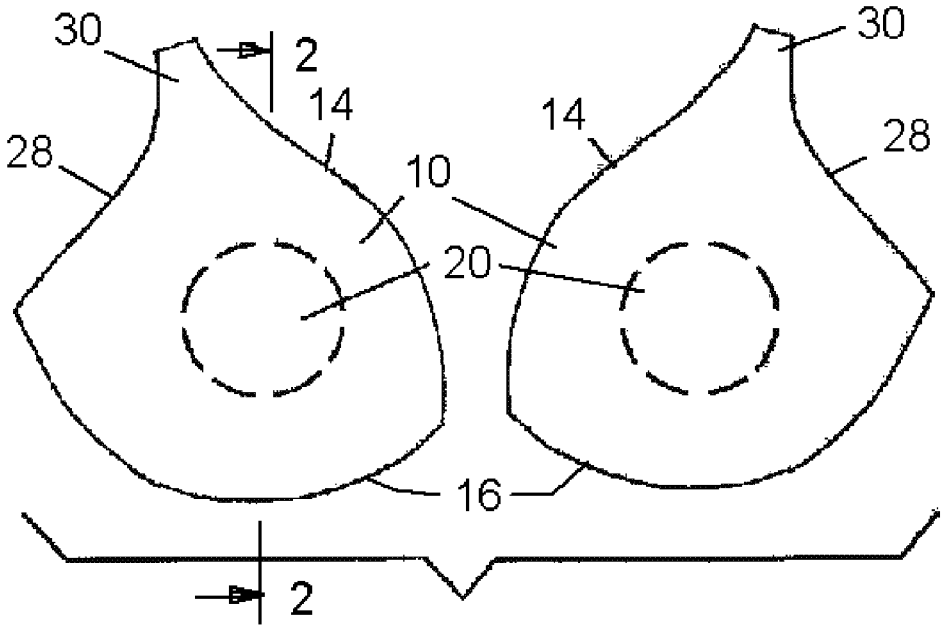
FIG. 7

BREAST PAD CONSTRUCTION WITH IMPROVED NIPPLE CONCEALMENT

FIELD AND BACKGROUND OF THE INVENTION

The present invention relates generally to the field of bras and garments containing breast supporting components, and in particular to a new and useful breast pad construction with improved nipple concealment for use in bras, camisoles, slips, dresses, swimsuits or any other breast covering garment having breast supporting components therein.

It is known to provide resilient pads in bras to accentuate the figure and support the breasts of a woman. While thick pads are effective in concealing the nipples of a wearer, they also add extra weight that may not be desirable. Bras without pads are known but these have limited ability to enhance the figure and often are too thin to adequately conceal the nipples of a woman wearing the bra.

U.S. Pat. No. 7,311,583 issued Dec. 25, 2007 to Jagaric, et al. and assigned to the assignee of the subject application, discloses a light weight breast pad construction for a bra or garment with breast supporting component, having a thicker or denser summit area for each pad for concealing each nipple. Although generally effective, in some cases the nipples of a wearer are not full concealed. U.S. Pat. No. 7,311,583, as well as U.S. Pat. No. 7,052,360 issued May 30, 2006 and U.S. Pat. No. 6,997,775 issued Feb. 15, 2006 on applications in the same patent family as U.S. Pat. No. 7,311, 583, are incorporated here by reference for their teaching of methods for manufacturing and materials for use in bra pads and breast covering pads for other garments.

FIG. 1 shows a bra pad of the prior art, in particular U.S. Pat. No. 7,311,583, where the pad is a three dimensional cup-shaped structure 100 that comprises a top fabric layer 112 of flexible fabric material, a top foam layer 118 of resilient and formable foam material adhered to an inner surface of the top fabric layer, and a nipple concealing shaved disk 120 of resilient and formable foam material adhered to an inner surface of the top foam layer 118, or formed as part of the inner surface of the top foam layer 118. A bottom foam layer 124 of resilient and formable foam material is adhered directly to an inner surface of the top foam layer 118 and disk 120, and a fabric lining layer 126 of flexible fabric material is adhered to an inner surface of the bottom foam layer 124. As shown in the photograph of FIG. 4, where a model is wearing a bra with pads construction according to FIG. 1, even though there is some concealment of the nipples, they can still be detected at the outer surface of the bra.

Improvements thus can still be made in light weight but supportive breast covering pads that have effective nipple concealing properties but which do not add excessive weight or bulk to the garment as would be the case for heavily padded bras.

SUMMARY OF THE INVENTION

It is an object of the present invention to provide a gel-free bra or other garment pad for breast support having a top fabric layer, a top preferably polyurethane foam layer adhered to an inner surface of the top fabric layer and a nipple concealing disk preferably of shaved polyurethane foam adhered to or formed as part of the inner surface of the top foam layer. The disk is at a nipple covering location of an outer perimeter of the pad and is preferably substantially circular. The disk perimeter is spaced inwardly on all sides from the outer perimeter of the pad and has a graduated thickness minimum at the disk perimeter and increases in thickness to a maximum at the center of the disk. A substantially 100%, preferably spandex fabric layer is adhered to the inner surface of the top foam layer and disk and a bottom preferably polyurethane foam layer is adhered to an inner surface of the spandex layer with a fabric lining layer adhered to the bottom foam layer.

The inventor has found that by including a substantially 100% spandex layer between the top and bottom foam layers that were used in the prior bra pads of U.S. Pat. No. 7,311,583, for example, added lift and effective nipple concealment is achieved while adding minimum weight and almost no bulk to the pad.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 6 is a front elevational view of a pair of pads of the subject invention before they have been cut out of the surrounding laminate structure but after a heat and pressure forming step that has created and fixed the three dimensional shape of the pads; and FIG. 7 is a front elevational view of the pair of pads of the subject invention after they have been cut out of the surrounding laminate and are ready to be sewn or otherwise fixed into a bra or other breast supporting garment.

DESCRIPTION OF THE PREFERRED EMBODIMENTS

Figure 2:
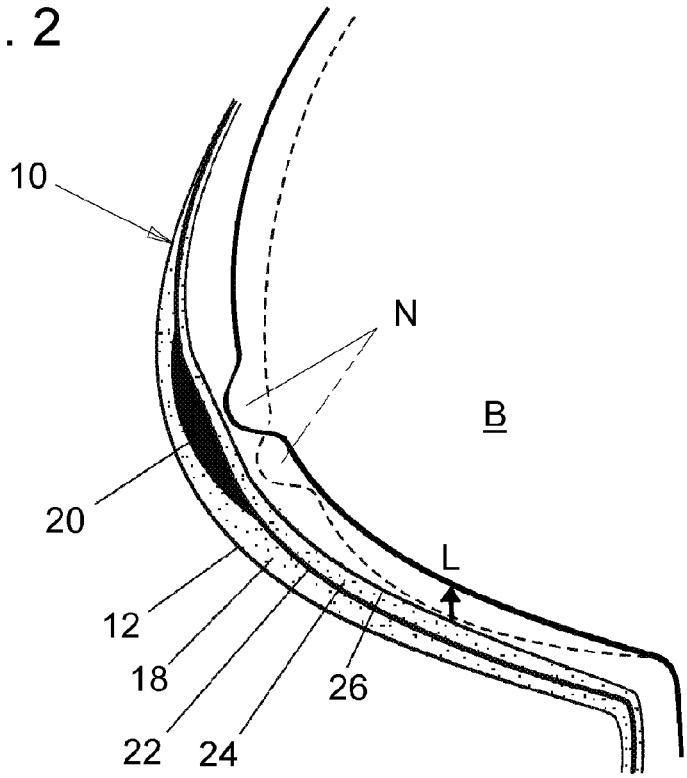
FIG. 2 is a sectional view of the gel-free pad of the invention, for a breast supporting garment, taken along line 2-2 of FIG. 7.

Referring now to the drawings, in which like reference numerals are used to refer to the same or similar elements, FIG. 2 shows a gel-free pad 10 of the invention for supporting a breast B in a garment such as bras, camisoles, slips, dresses, swimsuits or any other breast covering garment having breast supporting components therein.

The pad 10 comprising a top fabric layer 12 of flexible fabric material such a nylon or nylon plus spandex blend. The top fabric layer 12 and, as shown in FIG. 7, the entire pad 10, has an outer perimeter with a convexly curved neckline edge 14 and a convexly curved under-breast edge 16. Neckline edge 14 may be straight or even slightly concavely curved but in any case the outer perimeter of the top fabric layer 12 as well as most of the other layers of the pad, correspond to the outer perimeter of the pad.

A top, preferably thermoplastic or other heat and pressure formable and resilient foam layer 18 is adhered to an inner surface of the top fabric layer 12 and also has a perimeter corresponding to the outer perimeter of the pad 10. The preferred thermoplastic material for the foam layers of the invention is polyurethane.

A nipple concealing disk 20 that is preferably circular and preferable made from a shaved thicker polyurethane foam or other resilient material in the manner taught in U.S. Pat. No. 7,311,583, is adhered to an inner surface of the top foam layer 18, or is formed as part of the inner surface of the top foam layer 18. The nipple concealing disk is disposed at a nipple covering location that is generally central to the outer perimeter of the pad 10 as shown in FIG. 7. Its preferably substantially circular disk perimeter is spaced inwardly on all sides from the outer perimeter of the pad 10. As shown in FIG. 2 the disk 20 has a graduated thickness that is at a minimum at the disk perimeter and increases to a maximum thickness substantially at a center of the disk. Dimensions of the substantially circular shaved disk 20 are different for different sized bras but for a size 34B bra, for example, the diameter of shaved disk 20 may be about 2.5 to 3 inches.

A substantially 100% spandex or other elastomer-fiber based fabric layer 22 of woven or knit elastomer containing fibers is adhered to the inner surface of the top foam layer 18 and an inner surface of the nipple concealing disk 20, this preferably spandex fiber fabric layer having a perimeter corresponding to the outer perimeter of the pad. The preferred elastomer fiber fabric layer 22 is made of 100% unclad spandex of about denier 20D to 140D (preferably denier 50D to 110D) and a knit of picks/inch (CPI) 117+/−20% and wales/inch (WPI) 69+/−20%. The fabric layer 22 is, for example, warp knit tricot of 150 grams per square meter weight. Clad spandex might also be used.

Fabric of 100% spandex identified as FB5984 by Best Pacific (also called Best Pacific 12524) as been used for layer 22 in pads 10 manufactured and tested for this invention. While fabric layer 22 is preferably 100% spandex, other elastomer based fabrics with good elongation, effective recovery and soft hand-feeling can alternatively be used to perform the same function.

Figure 3:
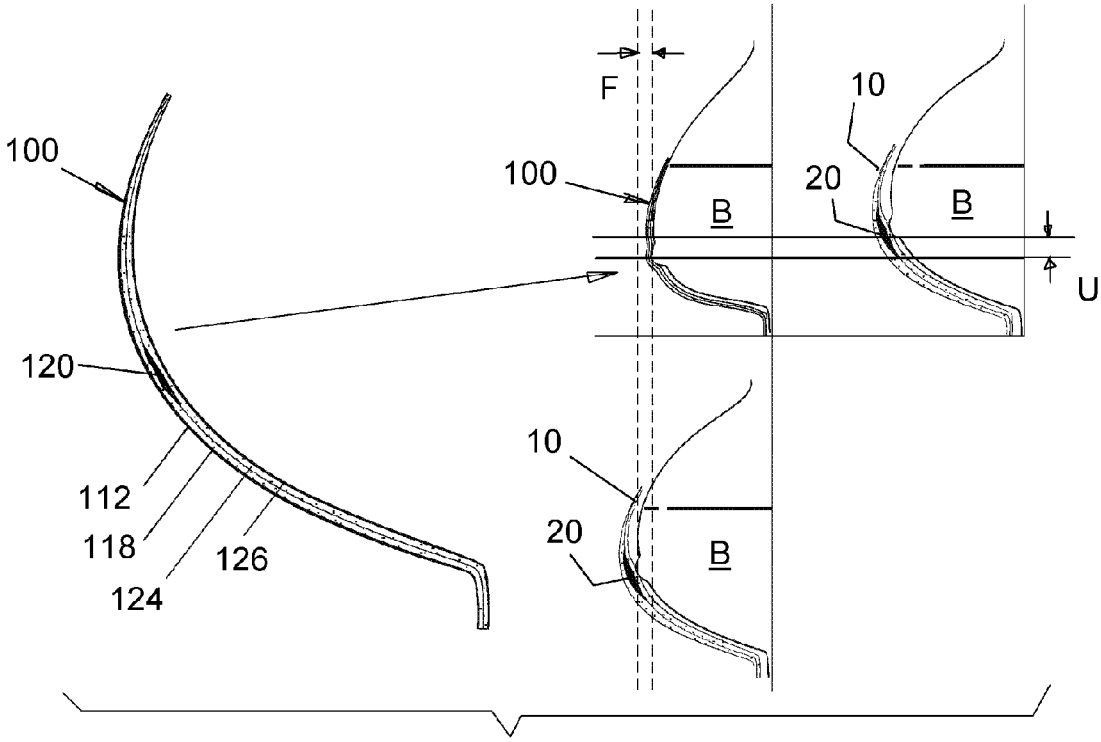
FIG. 3 is a multi-part explanatory view comparing the pad of the invention to a bra pad of the prior art to demonstrate the improved results achieved by the invention.

As will be explained later in this disclosure and as will be further illustrated in FIGS. 2 and 3, the inclusion of this single thin and light elastomer-fiber based fabric layer 22 has an unexpected and advantageous effect on concealing the nipples both due to better coverage and due to better support and therefore centering of the nipples on the nipple concealing disks 20 of the pads 10.

With further reference to FIGS. 2 and 7, each pad 10 also includes a bottom, preferably polyurethane or other resilient and formable foam layer 24, adhered to an inner surface of the elastomer fiber fabric layer 22. This bottom foam layer 24 also has a perimeter corresponding to the outer perimeter of the pad 10. A fabric lining layer 26 of flexible fabric material is adhered to an inner surface of the bottom foam layer 24 and also has a perimeter corresponding to the outer perimeter of the pad 10 as shown in FIG. 7. Lining 26 is also make of nylon or nylon spandex blend.

The outer perimeter of each pad 10 includes the convexly curved, straight or even concavely curved neckline edge 14, the convexly curved under-breast edge 16, where an underwire (not shown) may be included in the completed breast supporting bra or garment, an arm edge 28 for being positioned adjacent the wear's arm, and a shoulder strap projection 30 between the neckline edge 14 and the arm edge 28. In an alternative outer perimeter for a strapless bra or garment, the neckline edge 14 may curve smoothly into the arm edge 28 with no shoulder strap projection 30 being present.

As taught in U.S. Pat. No. 7,311,583, a pair of pads 10, 10 as shown in FIG. 6, are formed together in one laminate 40 of foam and fabric layers and disks 20, that are pressed and heated together in a mold set for creating the three dimensional shape of the pads as shown in FIG. 2, but according to the present invention the 100% spandex fabric layer 22 is also included and is integrated by adhesion of the heat adhereable materials into the pad structures. The pads 10 are then separated by being cut out of the laminate 40 alone the outer pad perimeters. The pads 10 are then sewn or otherwise assembled into a bra or garment in a manner that is know to those skilled in the art of this invention.

Figure 1:
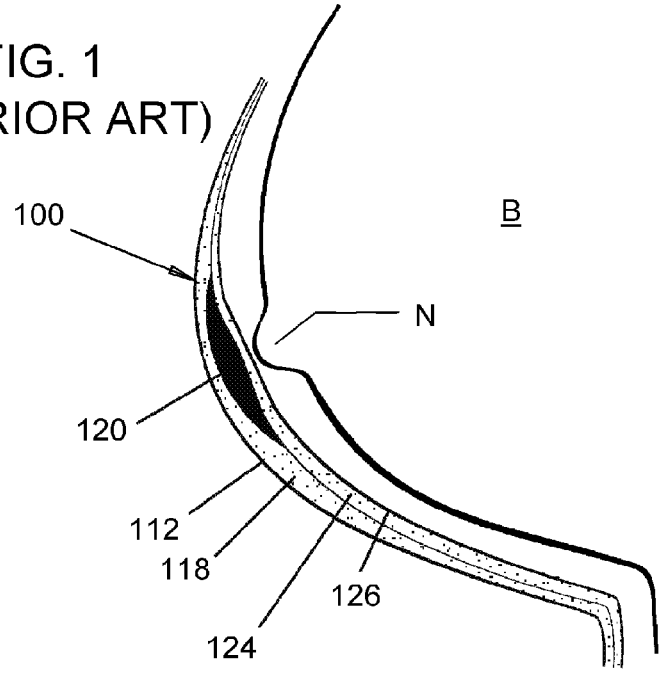
FIG. 1 (PRIOR ART)
FIG. 1 is a sectional view of the breast pad of U.S. Pat. No. 7,311,583 showing material prior art to the subject invention.

FIG. 1, as noted above, illustrates the prior foam cup pad being improved upon by the present invention. There is no internal 100% spandex layer in the prior pad but only layers of foam on opposite sides of the disk 120. While this light layer of foam is useful for helping conceal the nipples N of the wearer's breast B, this is not always the case and it has also been found that sometimes the nipple is not properly or naturally centered on the disk 120 which further defeats its nipple concealing function. Although the ideal relative position for the nipple N and disk 120 are shown in FIG. 1, often the reality is shown in the dotted line position of the breast B and nipple N in FIG. 2, where in the natural support position of a breast in a bra or garment having the prior pad structure, proper centering of the nipple on the disk is not achieved.

The inventor has found that by adding the single layer of 100% elastomer fiber fabric layer 22 at the claimed location between the top and bottom foam layers, a lifting support force L in FIG. 2 is exerted on the breast B so as to lift the nipple N into a properly centered location behind the nipple concealing disk 20. The added layer 22 also helps further conceal the nipple as well, but without adding much weight and almost no bulk to the pad 10.

The invention has improved nipple concealment while maintaining good support for the breast. The six layers only of the improved bra pad construction has a substantial advantage over the five layered prior pad as also shown in FIG. 3 while helping make the wearer's body more natural looking. The added layer 22 of 100% spandex with its elongation and recovery characteristics also provides a long-lasting support and flexibility for the foam pads 10.

Figure 4:
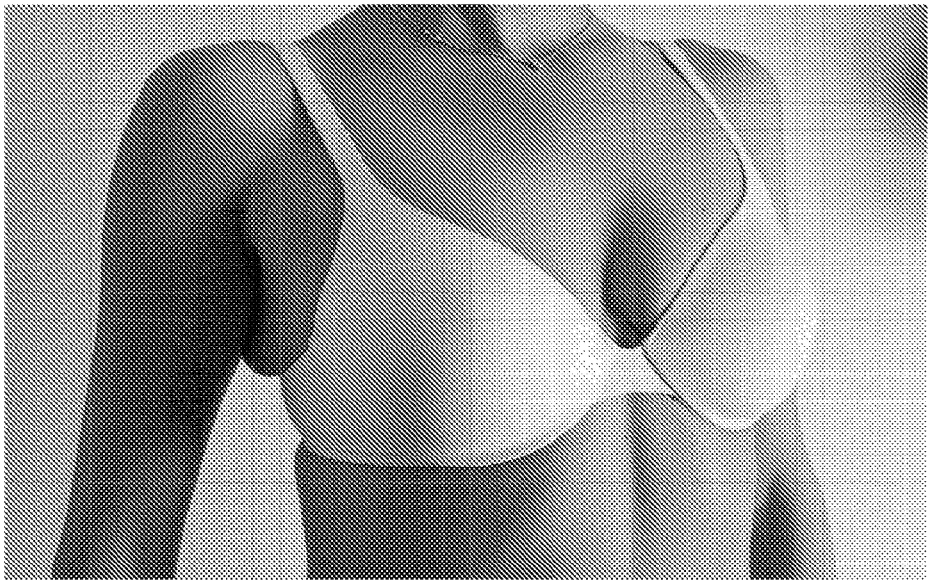
FIG. 4 (PRIOR ART)
FIG. 4 is a photograph of a model wearing a bra manufactured with the pad of U.S. Pat. No. 7,311,583 showing that the nipples has not been fully concealed.
Figure 5:
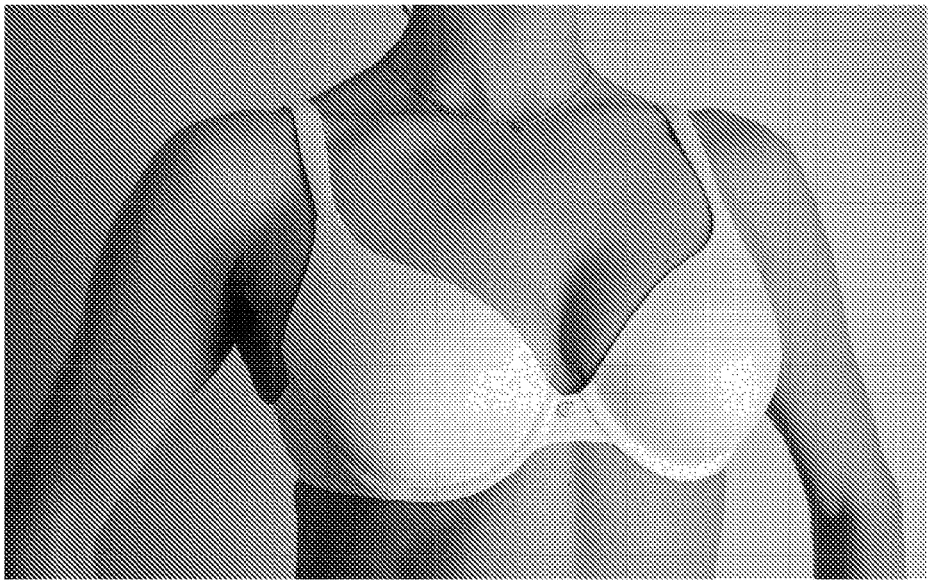
FIG. 5 is a photograph of the same model wearing a bra manufactured with the pad of the subject invention showing that the nipples are now fully concealed.

The traditional lightly lined bra lacks support for the body because of the thinness of the foam and meanwhile the nipples will protrude easily and so performance will not be very satisfying. The invention has solved this problem well in the simplest manner. As shown in FIG. 3, the new pad 10 lifts the breast by a distance U over the prior pad structure, thus centering the wearer's nipple behind the disk 20. This uplift by distance U at the same time moves the front of the breast forward by distance F, thus accentuating the breast further. The contrast between the prior structure and the invention can be seen in FIG. 3 and is illustrated further by comparing FIGS. 4 and 5 where same model photographed during the same time frame is shown wearing a bra manufactured with the prior art pad in FIG. 4 and the pad of the invention in FIG. 5. The improved pad thus makes the wearer more confident and helps her body look more natural but with full concealment of the nipples.

While a specific embodiment of the invention has been shown and described in detail to illustrate the application of the principles of the invention, it will be understood that the invention may be embodied otherwise without departing from such principles.

What is claimed is:

1. A gel-free pad for a breast supporting garment comprising:

a top fabric layer of flexible fabric material having a perimeter with a neckline edge and a curved under-breast edge corresponding to an outer perimeter of the pad;

a top foam layer of resilient and formable foam material adhered to an inner surface of the top fabric layer and having a perimeter corresponding to the outer perimeter of the pad;

a nipple concealing disk of resilient and formable foam material adhered to an inner surface of the top foam layer or being formed as part of the inner surface of the top foam layer, the nipple concealing disk being at a nipple covering location of the outer perimeter of the pad and having a disk perimeter spaced inwardly on all sides from the outer perimeter of the pad, the disk having a graduated thickness that is at a minimum at the disk perimeter and increases to a maximum thickness at a center of the disk;

a substantially 100% elastomer fiber fabric layer of woven or knit elastomer fibers adhered to the inner surface of the top foam layer and an inner surface of the nipple concealing disk, the elastomer fiber fabric layer having a perimeter corresponding to the outer perimeter of the pad;

a bottom foam layer of resilient and formable foam material adhered to an inner surface of the elastomer fiber fabric layer, the bottom foam layer having a perimeter corresponding to the outer perimeter of the pad; and a fabric lining layer of flexible fabric material adhered to an inner surface of the bottom foam layer and having a perimeter corresponding to the outer perimeter of the pad.

2. A pad according to claim 1, wherein the elastomer fiber fabric layer is made of 100% spandex.

3. A pad according to claim 1, wherein the material of all of the foam layers and the disk comprises thermoplastic material.

4. A pad according to claim 1, wherein the material of all of the foam layers and the disk comprises polyurethane foam.

5. A pad according to claim 1, wherein the disk perimeter is substantially a circle.

6. A pad according to claim 1, wherein the disk perimeter is substantially a circle, the outer perimeter including an arm edge and a shoulder strap projection between the neckline edge and the arm edge, the neckline edge being curved convexly.

7. A pad according to claim 1, wherein the elastomer fiber fabric layer is made of 100% spandex of about denier 20 to 140.

8. A pad according to claim 1, wherein the elastomer fiber fabric layer is made of 100% unclad spandex.

9. A pad according to claim 1, wherein the elastomer fiber fabric layer is made of 100% spandex of about denier 20 D to 140 D and a knit of picks/inch 117+/−20% and wales/inch 69+/−20%.

10. A pad according to claim 1, wherein the elastomer fiber fabric layer is made of 100% spandex of about denier 20 D to 140 D and a knit of picks/inch 117+−20% and wales/inch 69+/−20%, the material of all of the foam layers and the disk comprising polyurethane foam.

11. A pad according to claim 1, wherein the elastomer fiber fabric layer is made of 100% spandex of about denier 20 D to 140 D and a knit of picks/inch 117+/−20% and wales/inch 69+/−20%, the material of all of the foam layers and the disk comprising polyurethane foam, the disk perimeter being substantially a circle and the outer perimeter including an arm edge and a shoulder strap projection between the neckline edge and the arm edge, the neckline edge being curved convexly.

12. A pad according to claim 1, wherein the a nipple concealing disk has a substantially circular perimeter and is adhered to an inner surface of the top foam layer.

13. A pad according to claim 1, wherein the a nipple concealing disk has a substantially circular perimeter and is formed as part of the inner surface of the top foam layer.

14. A pad according to claim 1, wherein the elastomer fiber fabric layer is made of 100% spandex and the material of all of the foam layers and the disk comprises thermoplastic material.

15. A pad according to claim 1, wherein the top and lining fabric layers are made of nylon or a nylon with spandex blend.

16. A gel-free pad for a breast supporting garment comprising:

a top fabric layer of flexible fabric material having a perimeter with a neckline edge and a curved under-breast edge corresponding to an outer perimeter of the pad;

a top polyurethane foam layer adhered to an inner surface of the top fabric layer and having a perimeter corresponding to the outer perimeter of the pad;

a nipple concealing disk of shaved polyurethane foam material adhered to an inner surface of the top foam layer or being formed as part of the inner surface of the top foam layer, the nipple concealing disk being at a nipple covering location of the outer perimeter of the pad and having a substantially circular disk perimeter spaced inwardly on all sides from the outer perimeter of the pad, the disk having a graduated thickness that is at a minimum at the disk perimeter and increases to a maximum thickness at a center of the disk;

a substantially 100% spandex fabric layer of woven or knit spandex fibers adhered to the inner surface of the top foam layer and an inner surface of the nipple concealing disk, the spandex fiber fabric layer having a perimeter corresponding to the outer perimeter of the pad;

a bottom polyurethane foam layer adhered to an inner surface of the elastomer fiber fabric layer, the bottom foam layer having a perimeter corresponding to the outer perimeter of the pad; and a fabric lining layer of flexible fabric material adhered to an inner surface of the bottom foam layer and having a perimeter corresponding to the outer perimeter of the pad.

17. A pad according to claim 16, wherein the outer perimeter includes an arm edge and a shoulder strap projection between the neckline edge and the arm edge, the neckline edge being curved convexly.

18. A pad according to claim 16, wherein the top and lining fabric layers are made of nylon or a nylon with spandex blend.

19. A gel-free pad for a breast supporting garment consisting essentially of:

a top fabric layer of flexible fabric material having a perimeter with a neckline edge and a curved under-breast edge corresponding to an outer perimeter of the pad;

a top polyurethane foam layer adhered to an inner surface of the top fabric layer and having a perimeter corresponding to the outer perimeter of the pad;

a nipple concealing disk of shaved polyurethane foam material adhered to an inner surface of the top foam layer or being formed as part of the inner surface of the top foam layer, the nipple concealing disk being at a nipple covering location of the outer perimeter of the pad and having a substantially circular disk perimeter spaced inwardly on all sides from the outer perimeter of the pad, the disk having a graduated thickness that is at a minimum at the disk perimeter and increases to a maximum thickness at a center of the disk;

a substantially 100% spandex fabric layer of woven or knit spandex fibers adhered to the inner surface of the top foam layer and an inner surface of the nipple concealing disk, the spandex fiber fabric layer having a perimeter corresponding to the outer perimeter of the pad;

a bottom polyurethane foam layer adhered to an inner surface of the elastomer fiber fabric layer, the bottom foam layer having a perimeter corresponding to the outer perimeter of the pad; and a fabric lining layer of flexible fabric material adhered to an inner surface of the bottom foam layer and having a perimeter corresponding to the outer perimeter of the pad;

the outer perimeter including an arm edge and a shoulder strap projection between the neckline edge and the arm edge, the neckline edge being curved convexly;

the top and lining fabric layers being made of nylon or a nylon with spandex blend.

20. A pad according to claim 19, wherein the elastomer fiber fabric layer is made of 100% spandex of about denier 20 D to 140 D and a warp knit of picks/inch 117+/−20% and wales/inch 69+/−20%.

* * * * *